United States Patent [19]

Sauls

[11] Patent Number: 4,876,532

[45] Date of Patent: Oct. 24, 1989

[54] VENDING RACK BURGLAR ALARM

[75] Inventor: Charles L. Sauls, Rockingham, N.C.

[73] Assignee: Fisher/Sauls Electronics, Inc., Rockingham, N.C.

[21] Appl. No.: 210,752

[22] Filed: Jun. 23, 1988

[51] Int. Cl.[4] ..... G08B 13/14

[52] U.S. Cl. ..... 340/689; 221/3; 340/540; 340/522; 340/571; 340/636

[58] Field of Search ..... 340/689, 540, 571, 522, 340/530, 529, 636; 221/3, 2

[56] References Cited

U.S. PATENT DOCUMENTS

| | | | |
|---|---|---|---|
| 1,291,051 | 1/1919 | McQuarrie | 340/689 |
| 1,817,002 | 8/1931 | Halstead | 340/689 |
| 3,440,636 | 4/1969 | Sliman | 340/571 |
| 3,740,648 | 6/1973 | Grotjohn | 340/689 |
| 3,959,789 | 5/1976 | McGahee | 340/529 |
| 3,999,178 | 12/1976 | Hamilton | 340/529 |
| 4,016,535 | 4/1977 | Dinlocker | 340/52 H |
| 4,297,683 | 10/1981 | Roberts | 340/689 |
| 4,404,549 | 9/1983 | Berg | 340/636 |

*Primary Examiner*—Glen R. Swann, III

*Attorney, Agent, or Firm*—Bell, Seltzer, Park & Gibson

[57] ABSTRACT

A vending machine is disclosed which is protected from theft or pilferage through an alarm device contained within the vending machine. The alarm device is mounted within the vending machine and sounds an alarm when the vending machine is moved or tilted more than a certain amount for a predetermined period of time. The alarm device is inexpensive, compact and easy to install requiring little modification to existing vending machines.

14 Claims, 3 Drawing Sheets

VENDING RACK BURGLAR ALARM

FIELD OF THE INVENTION

This invention relates to burglar alarms for vending machines.

BACKGROUND OF THE INVENTION

One of the problems facing owners of vending machines is destruction of their coin operated machines by thieves, both professional and amateur. When one tries to break into a machine, the destruction of the machine is the only way to reach the coin compartment. This wanton destruction of expensive vending machines calls for a specialized burglar alarm.

This invention is especially appropriate for use with newspaper vending racks. Most newspaper vending racks are formed of two parts. The top part includes a locked coin compartment which contains a coin receiving mechanism. Beneath the coin compartment is a newspaper compartment with a hinged door which is unlatched when the appropriate amount of money is deposited in the coin receiving mechanism. The vending racks are often anchored to their position by chains wrapped around sign posts or mail boxes. However, thieves often cut the chain anchoring the rack to its location.

No burglar alarms presently address the specific problems of vending machines. Vending machines are usually tampered with by amateurs who attempt to break into the rack and fail, but in the process damage the vending machine. More experienced thieves may have the equipment to seize an entire vending machine and remove it to a remote location before breaking into the coin compartment.

An alarm system designed to deal with both modes of theft must take into consideration the customers who buy goods from the rack. Slamming the door must not set off the alarm. Getting money out of the coin return should not set the alarm off and some shaking of the rack should not set off the alarm.

Therefore, it is an object of the present invention to provide an alarm device appropriate for use in vending machines.

It is another object of the invention to provide an alarm system especially designed for newspaper vending machines which is easily installed in conventional newspaper vending racks.

It is another object of the present invention to sound an alarm upon the occurrence of certain movements of a vending machine at the machine's location to help scare any thief and to alert the authorities to criminal activity.

SUMMARY OF THE INVENTION

The present invention provides a vending machine that is protected from theft or pilferage through an alarm device contained within the vending machine The vending machine has a housing which has a vending compartment for receiving and storing articles sold inside the vending compartment. The vending machine also has an enclosed locking coin compartment carried by the housing. The coin compartment has a coin receiving mechanism. The alarm device is contained in the coin compartment. When the vending machine is moved or tilted a predetermined amount for a predetermined period of time, an audible alarm within the alarm device sounds for so long as the box remains tilted. The alarm device is inexpensive, easy to install and difficult to disengage. More specifically, the alarm unit may comprise a tilt responsive switch having switch contacts which are activated in response to a predetermined amount of tilting from a level orientation, a delay circuit cooperating with the alarm so as to effect a sounding of the alarm a predetermined amount of time after tilting occurs.

DESCRIPTION OF THE DRAWINGS

The features and advantages of the present invention will become apparent from the following description when taken in conjunction with the accompanying drawings in which.

Like characters refer to like elements throughout.

DETAILED DESCRIPTION OF THE PREFERRED EMBODIMENT

While the invention will be described in connection with a preferred embodiment, it will be understood that Applicant does not intend to limit the invention to that embodiment. On the contrary, Applicant intends to cover all alternatives, modifications and equivalents as may be included within the spirit and scope of the invention as defined by the appended claims.

Figure 1:
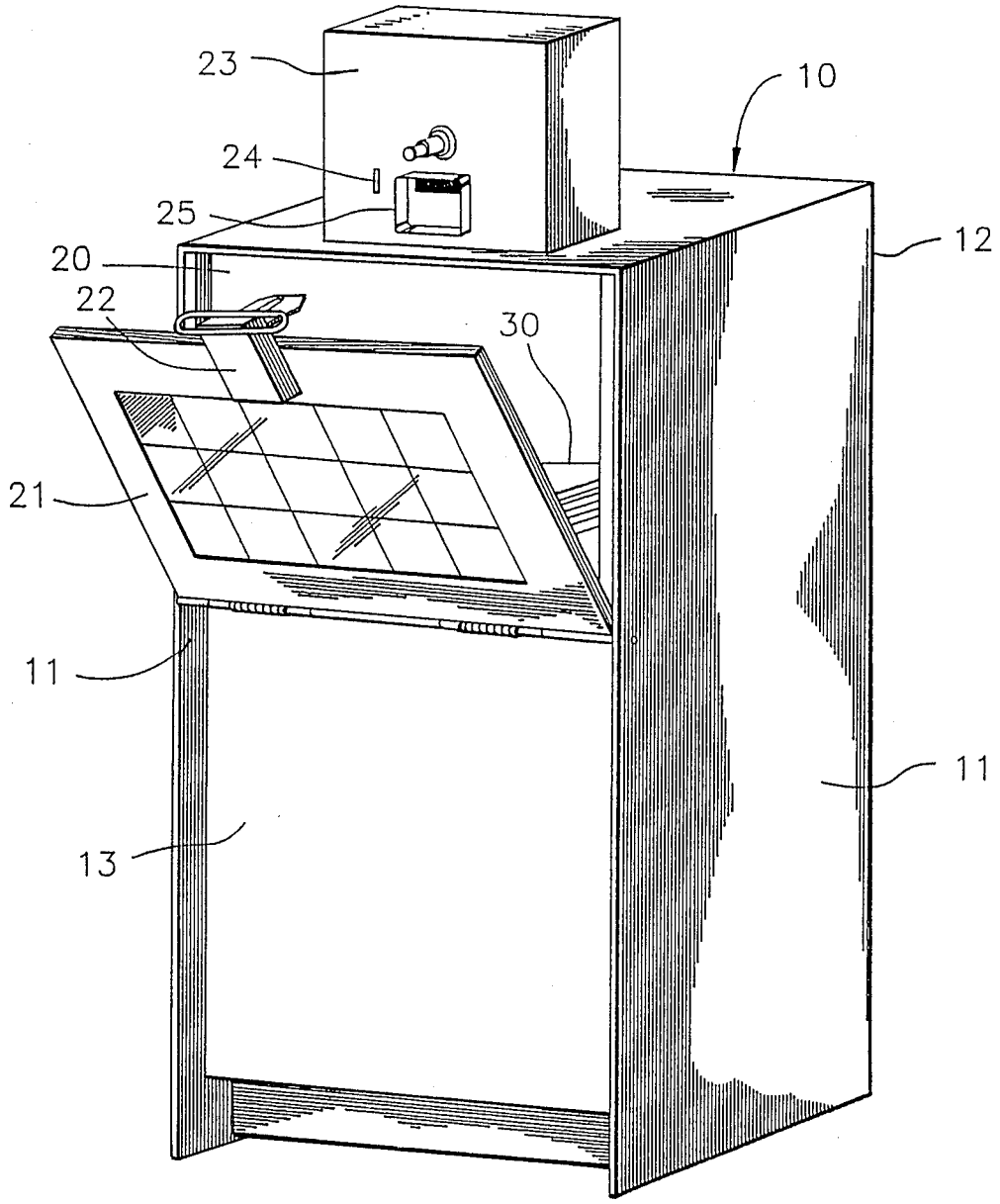
FIG. 1 shows a newspaper rack vending machine as it is normally positioned.

Referring to FIG. 1, a vending machine, in this case a newspaper rack, is shown. The vending machine has a housing 10 formed by two parallel side walls 11, a rear wall 12 and a front wall 13. In the upper portion of the housing is provided a vending compartment 20 which receives and stores the articles vended by the machine. The vending compartment 20 has a hinged door 21 to provide access to the vended articles. The hinged door 21 has a latch 22 for maintaining the door in a normally latched condition. The housing carries an enclosed lockable coin compartment 23. The coin compartment 23 has a coin slot 24 connected to a coin receiving mechanism mounted inside. A latch mechanism 25 is also mounted within the coin compartment and is operable for unlatching the latch 22 of the hinged door 21 upon receipt of coins by the coin receiving mechanism.

Figure 2:
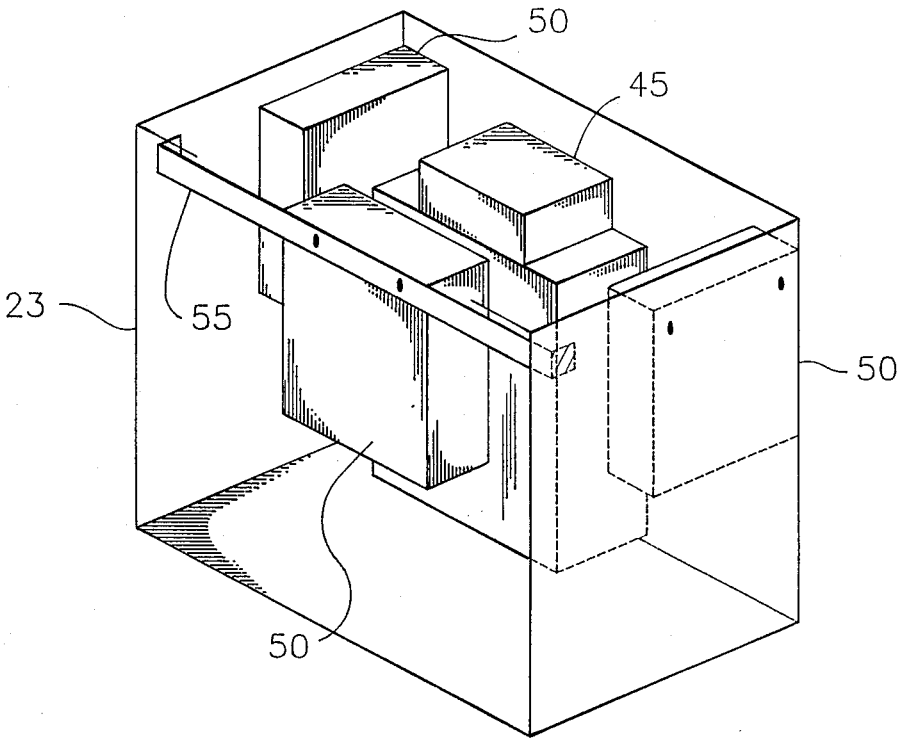
FIG. 2 shows a cutaway rear view of the coin box with top and back sides removed and the alarm unit shown in different positions inside the coin box.

Referring now to FIG. 2, the coin compartment 23 is shown. A coin receiving mechanism 45 is mounted interiorly of the coin compartment 23. An alarm unit 50 in the form of a compact self-contained unit, is also mounted inside the coin compartment 23. Three positions for the mounting of the alarm unit 50 are shown. Others are also possible The only requirement for the mounting of the alarm unit 50 is that it is mounted level within the coin compartment. Thus for example, if the surface upon which the vending machine is positioned is not level, the alarm device will be nonetheless mounted in a level orientation. Device 55 is a mounting strip to assist in mounting the alarm unit and leveling it. The dimensions of the alarm unit 50 are small so as to fit inside the coin compartment of a conventional newspaper box without requiring modifications. Since the alarm unit 50 is within the locked coin compartment 23 and the coin compartment is difficult to break into, it will be quite difficult to disengage the alarm.

Figure 3:
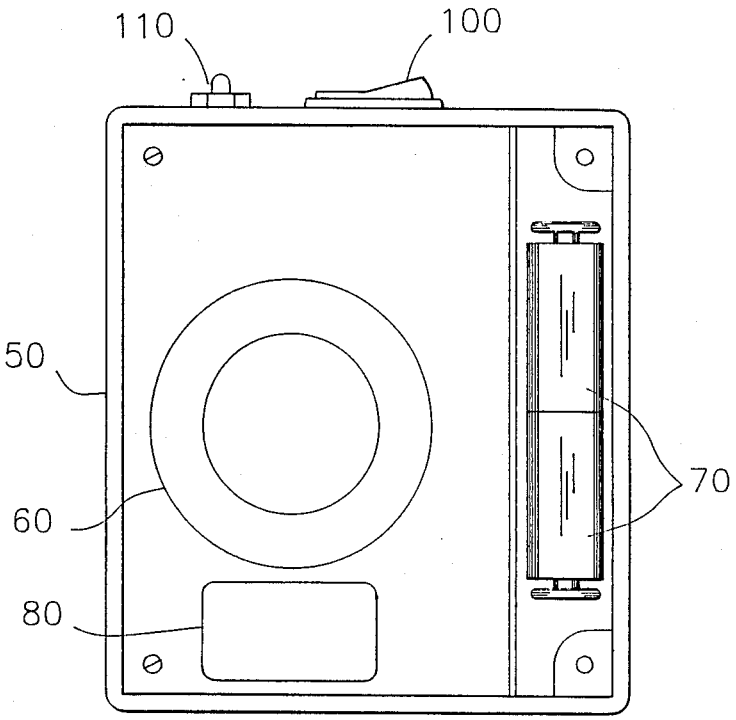
FIG. 3 shows a cross section of the alarm unit box.

In FIG. 3, a cross section of the alarm unit 50 is shown. The alarm unit 50 contains an audible alarm 60, such as a horn, which sounds when the vending machine is tilted or moved for more than a predetermined period of time. The alarm device is powered by two batteries 70 (typically, the batteries are nine volt). Since many vending machines may be in remote areas, the alarm should be quite loud.

As specifically illustrated in FIG. 3, the alarm unit contains a control board 80 and, the circuitry of the alarm unit is located on the board 80. An on/off switch 100 is located on the outside of the alarm unit 50 and turns power on and off. A second switch 110 will indicate whether the battery charge is low and is preferably a push button switch which lights a lamp, such as a light emitting diode (LED), to indicate that both batteries are operational.

Figure 4:
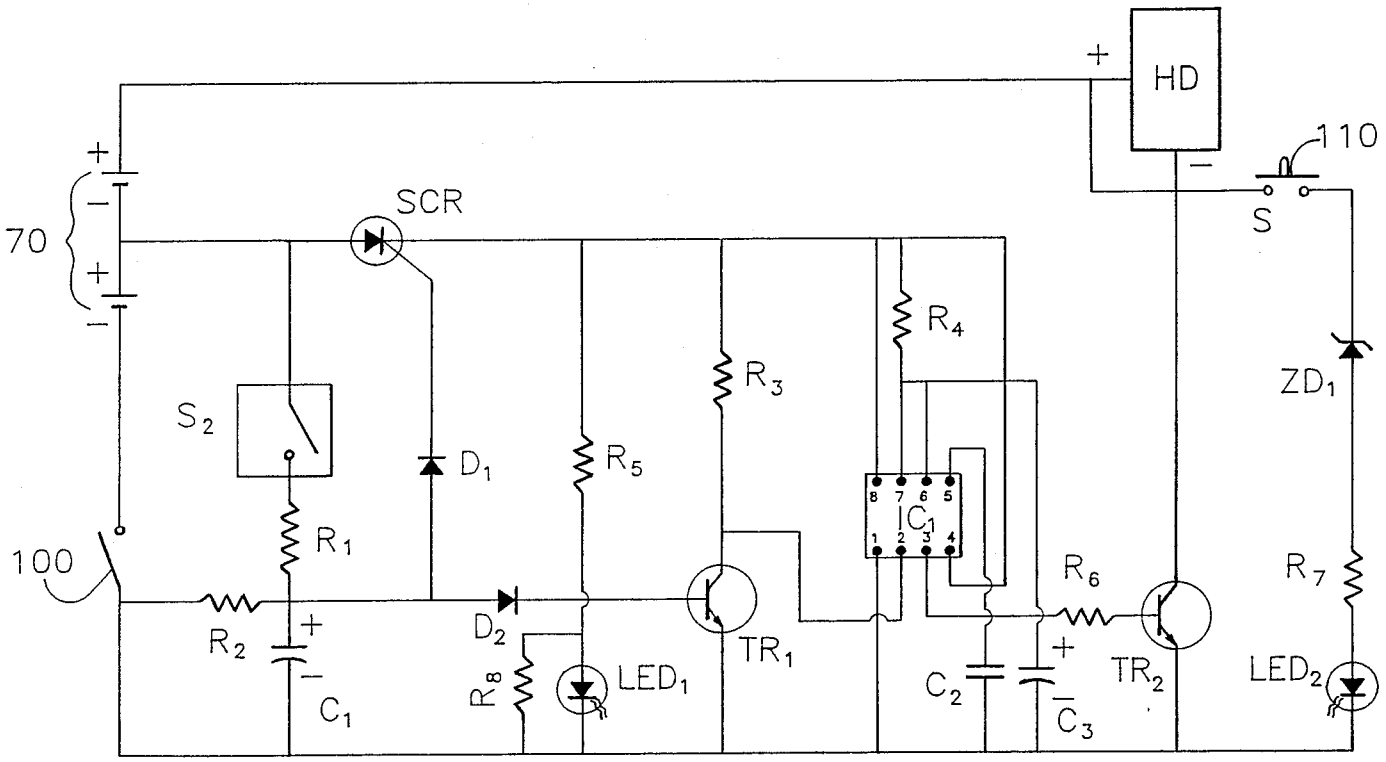
FIG. 4 shows a schematic drawing of the circuitry of the alarm unit.

Referring to FIG. 4, in operation when the switch 100 is closed the alarm device is energized by batteries 70. When the vending machine is tilted more than a predetermined amount a tilt switch $S_2$ closes. A variety of devices can be suitably employed as the tilt switch. In the preferred embodiment, a disk-like normally-open mercury switch is employed which is responsive to titling in any direction from a horizontal or level orientation. Preferably, the switch should be actuated (e.g. closed) in response to tilting in excess of 30 degrees, and most desirably the switch should be responsive to a tilting of 20 degrees or more. When tilt switch $S_2$ is closed, voltage is then supplied, to capacitor C1, here 5 volts. Capacitor C1 then begins to charge acting as a time delay for a period of time which may for example be 3 seconds.

As capacitor C1 charges, the voltage at switching diodes D1 and D2 increases until it reaches a certain voltage, e.g. 0.6 volts. When switching diodes D1 and D2 reaches this desired voltage, they break down and send forward biasing current to the silicon controlled rectifier SCR, which turns on the circuit, and then to transistor TR1. Transistor TR1 then activates the integrated circuit IC1. In the embodiment of FIG. 4, IC1 is a 555 timer, used to achieve accurate time delays. Pin 1 on integrated circuit 1C1 is connected to ground. Pin 2 is the trigger and receives signals from transistor TR1; pin 5 is the control voltage pin; pin 6 is the threshold pin; pin 7 is the discharge pin and pin 8 is connected to the power supply. When integrated circuit IC1 is triggered, the signal from pin 3 activates a second transistor TR2. Transistor TR2 then energizes the horn driver HD. The horn driver sounds the audible alarm and the SCR1 energizes the light emitting device LED1.

When the tilt switch S2 is open (i.e. vending machine is at less than the preselected angle) the current flow to capacitor C1 and transistor TR1 stops. Capacitor C1 continues to keep transistor TR1 energized while capacitor C1 discharges. Switching diodes D1 and D2 allow the capacitor C1 discharge current to flow until the voltage drops below a certain level (for example, 3 volts). At that point, switching diode D1 no longer conducts and current to transistor TR1 stops.

The integrated circuit IC1 operates in this time delay mode as follows. External capacitor $C_2$ is initially held discharged by a transistor inside integrated circuit IC1. Upon the triggering of pin 2, the flip-flop is set which both releases the short circuit across the capacitor and drives the output on pin 3 high. The voltage across capacitor $C_2$ then increases exponentially for a period of $t=1.1R_4C_3$ at the end of which time the voltage across capacitor $C_2$ equals two thirds of power supply voltage The comparator then resets the flip-flop which in turn discharges the capacitor and drives the output to its low state. When current to transistor TR1 stops transistor TR1 no longer triggers pin 2 of integrated circuit IC1. A comparator inside integrated circuit IC1 resets the flip-flop, which in turn discharges the capacitor $C_2$. This discharge operates to delay the changing of the output pin 3 to a low state.

When the output pin 3 of integrated circuit IC1 turns off, the horn driver HD is de-energized, thereby silencing the horn. Light emitting diode LED1 remains lit indicating that an alarm condition did occur.

In order to test the battery voltage, one pushes push button 110 which sends current to light emitting diode LED 2 which then energizes. Resistors R7 and R4 and zener diode ZD1, drops the voltage to light emitting diode LED2 so that light emitting diode LED2 will not light up if the voltage is less than a certain amount (here, 12 volts) at the source, batteries 70. This indicates low voltage and the battery should be replaced.

That which is claimed is:

1. A vending machine, such as a newspaper vending rack, which is protected from theft or pilferage comprising, in combination a housing, a vending compartment provided in said housing for receiving and storing the articles to be vended by the machine, an enclosed locking coin compartment carried by said housing, a coin receiving mechanism located within said coin compartment, an audible alarm, and means located within said enclosed locking coin compartment for sounding said audible alarm in response to movement of said housing beyond a predetermined limited range of movement occurring for a predetermined time duration.

2. A vending machine as set forth in claim 1 wherein said means for sounding said alarm includes means responsive to tilting of said housing more than about twenty degrees for a duration of about three seconds or longer.

3. A vending machine as set forth in claim 1 wherein said means for sounding said alarm includes a mercury tilt switch having switch contacts which are actuated in response to tilting of more than about twenty degrees, and a delay circuit cooperating with said mercury switch and connected to said audible alarm so as to effect sounding of said alarm in response to the contacts of the mercury switch remaining actuated for a minimum duration of about three seconds or longer.

4. A vending machine as set forth in claim 1 wherein said means for sounding said audible alarm comprises a resistor and capacitor delay circuit.

5. A vending machine as set forth in claim 1 wherein said means for sounding said audible alarm comprises a resistor, capacitor and integrated circuit delay circuit.

6. A newspaper vending rack, which is protected from theft or pilferage comprising, in combination a housing, a newspaper compartment provided in said housing for receiving and storing newspapers, a normally latched door providing access to said newspaper compartment, an enclosed lockable coin compartment carried by said housing, a coin receiving mechanism located within said coin compartment, a latch mechanism operable for unlatching said door upon receipt of coins by said coin receiving mechanism, an audible alarm located within said enclosed lockable coin compartment, and means located within said enclosed locking coin compartment for sounding said alarm in response to movement of said housing beyond a predetermined limited range of movement occurring for a predetermined time duration.

7. A newspaper rack as set forth in claim 6 including a self contained alarm unit located within said lockable coin compartment and secured thereto, and wherein said audible alarm and said means for sounding said alarm are housed within said alarm unit.

8. A newspaper rack as set forth in claim 6 wherein said alarm unit additionally includes battery means for powering said audible alarm.

9. A vending machine as set forth in claim 6 wherein said means for sounding said audible alarm comprises a resistor and capacitor delay circuit.

10. A vending machine as set forth in claim 6 wherein said means for sounding said audible alarm comprises a resistor, capacitor and integrated circuit delay circuit.

11. A newspaper vending rack, which is protected from theft or pilferage comprising, in combination a housing;

a newspaper compartment provided in said housing for receiving and storing newspapers;

a hinged door carried by said housing and providing access to said newspaper compartment, said door having a latch for maintaining the door in a normally latched condition;

an enclosed lockable coin compartment carried by said housing and having at least one set of parallel walls;

a coin receiving mechanism mounted within said coin compartment;

a latch mechanism mounted within said coin compartment and operable for unlatching said latch of said door upon receipt of coins by said coin receiving mechanism;

an alarm unit having a housing positioned within said coin compartment, said alarm unit comprising a tilt responsive switch having switch contacts which are activated in response to a predetermined amount of tilting from a level orientation, an audible alarm, and a delay circuit means cooperating with said audible alarm for sounding of the audible alarm a predetermined amount of time after tilting occurs; and means for mounting said housing to an inside wall of said coin compartment in a level orientation irrespective of the levelness of the coin compartment.

12. A vending machine as set forth in claim 11 including:

a battery test means for testing whether said battery is operational.

a battery test means for testing whether said battery is operational.

13. A vending machine as set forth in claim 11 wherein said delay circuit means comprises a resistor and capacitor delay circuit.

14. A vending machine as set forth in claim 11 wherein in said delay circuit means comprises a resistor, capacitor and integrated circuit delay circuit.

* * * * *

UNITED STATES PATENT AND TRADEMARK OFFICE

CERTIFICATE OF CORRECTION

PATENT NO. : 4,876,532

DATED : October 24, 1989

INVENTOR(S) : Charles L. Sauls

It is certified that error appears in the above-identified patent and that said Letters Patent is hereby corrected as shown below:

Column 1, line 58, after "machine" insert -- . --

Column 2, line 57, after "possible" insert -- . --

Column 3, line 27, "titling" should be -- tilting --

Column 3, line 39, "reaches" should be -- reach --

Column 3, line 54, "S2" should be -- $S_2$ --

Column 4, line 3, after "voltage" insert -- . --

Column 4, line 44, delete "about"

Column 4, line 45, before "duration" insert -- minimum --; delete "about"

Column 4, lines 45 and 46, delete "or longer"

Column 4, line 50, delete "about"

Column 4, line 55, delete "about" and "or longer"

Column 5, line 20, "6" should be -- 7 --

UNITED STATES PATENT AND TRADEMARK OFFICE

CERTIFICATE OF CORRECTION

PATENT NO. : 4,876,532

DATED : October 24, 1989

INVENTOR(S) : Charles L. Sauls

It is certified that error appears in the above-identified patent and that said Letters Patent is hereby corrected as shown below:

Column 6, line 17, delete "a"

Column 6, before line 26, please insert the following paragraph -- a battery within said alarm unit; and --

Column 6, lines 28 and 29, please delete "a battery test means for testing whether said battery is operational."

Column 6, line 34, delete "in"

Signed and Sealed this

Twentieth Day of November, 1990

*Attest:*

*Attesting Officer*

HARRY F. MANBECK, JR.

*Commissioner of Patents and Trademarks*